US009363606B2

(12) United States Patent
Nakamura

(10) Patent No.: US 9,363,606 B2
(45) Date of Patent: Jun. 7, 2016

(54) ACOUSTIC GENERATOR, ACOUSTIC GENERATING DEVICE, AND ELECTRONIC DEVICE

(71) Applicant: KYOCERA Corporation, Kyoto-shi, Kyoto (JP)

(72) Inventor: Shigenobu Nakamura, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/369,832

(22) PCT Filed: Jul. 31, 2013

(86) PCT No.: PCT/JP2013/070822
§ 371 (c)(1),
(2) Date: Jun. 30, 2014

(87) PCT Pub. No.: WO2014/045720
PCT Pub. Date: Mar. 27, 2014

(65) Prior Publication Data
US 2015/0003642 A1 Jan. 1, 2015

(30) Foreign Application Priority Data
Sep. 20, 2012 (JP) ..... 2012-207608

(51) Int. Cl.
*H04R 25/00* (2006.01)
*H04R 17/00* (2006.01)
*H04R 1/28* (2006.01)
*H04R 7/08* (2006.01)

(52) U.S. Cl.
CPC ..... *H04R 17/00* (2013.01); *H04R 1/288* (2013.01); *H04R 7/08* (2013.01)

(58) Field of Classification Search
CPC .... H04R 7/045; H04R 17/00; H04R 2440/05; H04R 17/005
See application file for complete search history.

(56) References Cited

U.S. PATENT DOCUMENTS

| | | | | |
|---|---|---|---|---|
| 6,522,760 | B2 * | 2/2003 | Azima | H04R 1/24 381/152 |
| 7,764,804 | B2 * | 7/2010 | Ohta | H04R 17/00 381/152 |
| 2006/0093165 | A1 * | 5/2006 | Kamimura | H04R 7/045 381/152 |
| 2006/0140424 | A1 * | 6/2006 | Kobayashi | H04R 7/045 381/190 |
| 2010/0067726 | A1 * | 3/2010 | Suzuki | G06F 1/1605 381/333 |
| 2013/0094681 | A1 | 4/2013 | Fukuoka et al. | |
| 2014/0241564 | A1 * | 8/2014 | Kang | H04R 7/045 381/386 |

FOREIGN PATENT DOCUMENTS

| | | | |
|---|---|---|---|
| JP | 08-205288 | A | 8/1996 |
| JP | 2004-023436 | A | 1/2004 |
| JP | 2012-110018 | A | 6/2012 |

OTHER PUBLICATIONS

International Search Report, PCT/JP2013/070822, Sep. 30, 2013, 1 pg.

* cited by examiner

*Primary Examiner* — Curtis Kuntz
*Assistant Examiner* — Ryan Robinson
(74) *Attorney, Agent, or Firm* — Volpe and Koenig, P.C.

(57) ABSTRACT

An acoustic generator according to an embodiment includes a vibrating body and an exciter. The exciter is provided on the vibrating body, and vibrates by an input of an electrical signal. The exciter includes a protrusion or a recess on/in a surface of a side of the vibrating body.

8 Claims, 10 Drawing Sheets

ACOUSTIC GENERATOR, ACOUSTIC GENERATING DEVICE, AND ELECTRONIC DEVICE

FIELD

Embodiments disclosed herewith relate to an acoustic generator, an acoustic generating device, and an electronic device.

BACKGROUND

Conventionally, acoustic generators represented by piezoelectric speakers are known to be used as small thin speakers. The acoustic generators can be used as speakers incorporated in electronic devices including mobile phones and thin televisions.

As the acoustic generator, there is an acoustic generator including a vibrating body and a piezoelectric vibrating element provided in the vibrating body (for example, see Patent Literature 1). This acoustic generator has a configuration to vibrate the vibrating body by the piezoelectric vibrating element, and to generate a sound using a resonance phenomenon of the vibrating body.

CITATION LIST

Patent Literature

Patent Literature 1: Japanese Laid-open Patent Publication No. 2004-23436

SUMMARY

An acoustic generator according to an aspect of embodiments includes a vibrating body, and an exciter provided on the vibrating body, wherein the exciter includes a protrusion or a recess on/in a surface of the vibrating body side.

DESCRIPTION OF EMBODIMENTS

Hereinafter, embodiments of an acoustic generator, an acoustic generating device, and an electronic device disclosed by the present application will be described in detail with reference to the appended drawings. Note that the present disclosure is not limited by embodiments described below.

First Embodiment

Figure 1A:
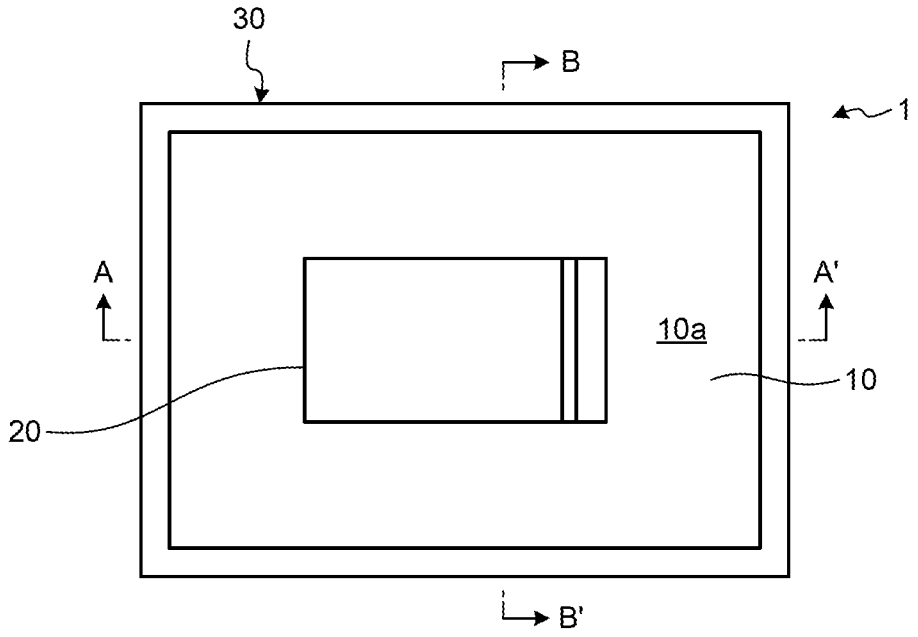
FIG. 1A is a schematic plan view of an acoustic generator according to a first embodiment.
Figure 1B:
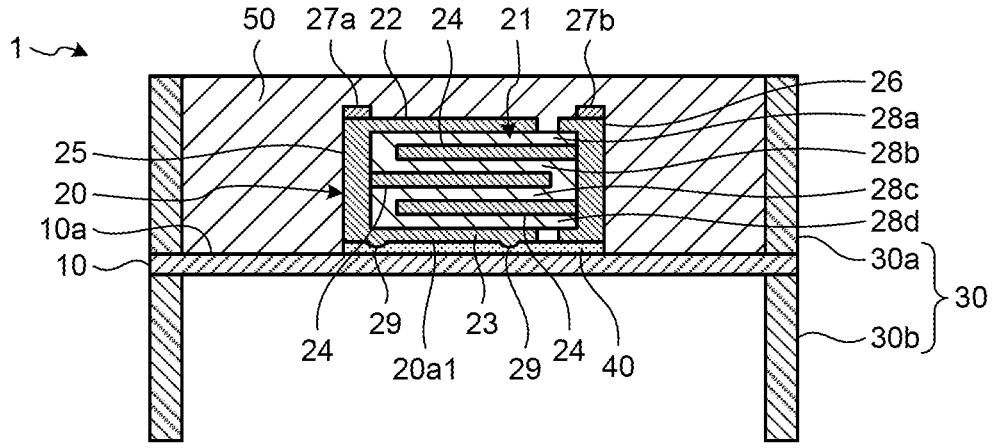
FIG. 1B is an A-A' line cross sectional view of FIG. 1A.
Figure 1C:
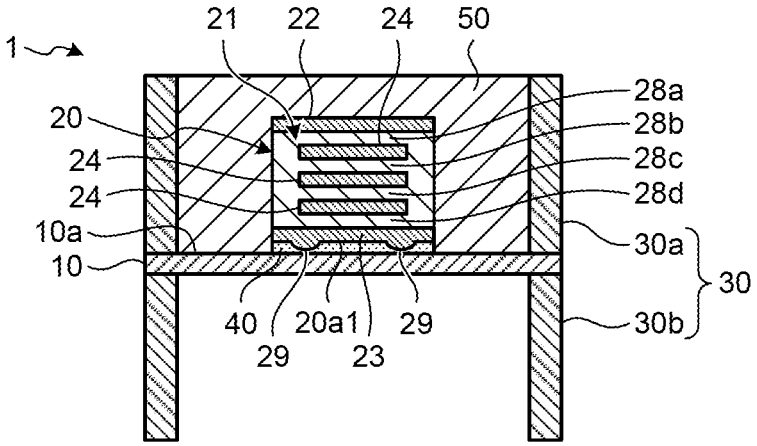
FIG. 1C is a B-B' line cross sectional view of FIG. 1A.

FIG. 1A is a schematic plan view of an acoustic generator 1 according to a first embodiment, as viewed from a direction perpendicular to a main surface of a vibrating body 10, FIG. 1B is an A-A' line cross sectional view of FIG. 1A, and FIG. 1C is a B-B' line cross sectional view of FIG. 1A. Note that, in FIGS. 1B and 1C, the acoustic generator 1 is extended in an up and down direction, and is deformed and illustrated, for easy understanding.

As illustrated in FIGS. 1A to 1C, the acoustic generator 1 according to the first embodiment includes the vibrating body 10, a piezoelectric vibrating element 20 that is an example of an exciter that vibrates by an input of an electrical signal, and a frame body 30. The acoustic generator 1 is so-called a piezoelectric speaker, and generates sound pressure using a resonance phenomenon of the vibrating body 10 itself.

The vibrating body 10 can be formed of various materials, such as resin, metal, and paper. For example, the thin plate vibrating body 10 can be configured from a resin film made of polyethylene, polyimide, polypropylene, or the like, and having the thickness of 10 to 200 μm. The resin film is a material having a lower elastic modulus and a lower mechanical Q value than a metal plate, and the like. Therefore, by configuring of the vibrating body 10 from a resin film, the vibrating body 10 performs bending vibration with large amplitude, the width of a resonant peak in a frequency characteristic of sound pressure is made large and the height of the resonant peak is made low, and a difference between the resonant peak and a dip can be decreased.

The piezoelectric vibrating element 20 is a bimorph multilayer piezoelectric vibrating element. For example, the piezoelectric vibrating element 20 includes a layered body 21, surface electrode layers 22 and 23 formed on an upper surface and a lower surface of the layered body 21, and external electrodes 25 and 26 formed on side surfaces where end surfaces of internal electrode layers 24 of the layered body 21 are exposed. Lead terminals 27*a* and 27*b* are connected to the external electrodes 25 and 26.

The layered body 21 is formed such that four piezoelectric layers 28*a*, 28*b*, 28*c*, and 28*d* made of ceramics, and three internal electrode layers 24 are alternately layered. Further, an upper main surface and a lower main surface of the piezoelectric vibrating element 20 have a rectangular shape. The piezoelectric layers 28*a* and 28*b*, and the piezoelectric layers 28*c* and 28*d* are polarized in mutually different directions in a thickness direction, respectively, and the piezoelectric layers 28*b* and 28*c* are polarized in the same direction.

Therefore, when a voltage is applied to the piezoelectric vibrating element 20 via the lead terminals 27*a* and 27*b*, for example, the piezoelectric layers 28*c* and 28*d* of a lower surface side of the piezoelectric vibrating element 20, in other words, of a vibrating body 10 side are deformed to contract, while the piezoelectric layers 28*a* and 28*b* of an upper surface are deformed to expand. In this way, the piezoelectric layers 28*a* and 28*b* of the upper surface side of the piezoelectric vibrating element 20 and the piezoelectric layers 28*c* and 28*d* of the lower surface side exert conflicting expansion/contraction behaviors. As a result, the piezoelectric vibrating element 20 performs bimorph bending vibration, thereby providing the vibrating body 10 with fixed vibration, and allowing the vibrating body 10 to generate a sound.

As described above, the piezoelectric vibrating element 20 is a bimorph multilayer piezoelectric vibrating element, and the piezoelectric vibrating element 20 itself independently performs bending vibration. Therefore, even a soft vibrating body 10 can generate strong vibration regardless of the material of the vibrating body 10, and sufficient sound pressure can be obtained by a small number of the piezoelectric vibrating elements 20.

Here, as the material that configures the piezoelectric layers 28*a*, 28*b*, 28*c*, and 28*d*, a conventionally-used piezoelectric ceramics such as lead zirconate titanate, and Bi layered compound and tungsten bronze structure compound, such as other non-lead piezoelectric substance materials, can be used.

Further, the material of the internal electrode layers 24 contains metal, such as silver and palladium, as main components. Note that the internal electrode layers 24 may contain the ceramic component that configures the piezoelectric layers 28*a*, 28*b*, 28*c*, and 28*d*. Accordingly, the piezoelectric vibrating element 20 from which a stress due to a thermal expansion difference between the piezoelectric layers 28*a*, 28*b*, 28*c*, and 28*d*, and the internal electrode layers 24, 24, and 24 is decreased can be obtained.

Further, the surface electrode layers 22 and 23 and the external electrodes 25 and 26 contain metal, such as silver, as a main component. Further, a glass component may be contained. By containing of the glass component, firm adhesive strength can be obtained between the piezoelectric layers 28*a*, 28*b*, 28*c*, and 28*d* and the internal electrode layers 24, and the surface electrode layers 22 and 23 or the external electrodes 25 and 26. The content of the glass component may just be, for example, 20 volume % or less.

Further, as wiring connected to the lead terminals 27*a* and 27*b*, it is favorable to use flexible wiring formed such that a metal foil made of copper or aluminum is sandwiched by resin films, in order to make the height of the piezoelectric vibrating element 20 lower.

The piezoelectric vibrating element 20 configured as described above is joined with one surface 10*a* (hereinafter, described as upper surface 10*a*) of the vibrating body 10 via a joining layer 40. The thickness of the joining layer 40 between these piezoelectric vibrating element 20 and vibrating body 10 is relatively thin, and is, for example, 0.02 to 20 μm, both inclusive. As described above, when the thickness of the joining layer 40 is 20 μm or less, the vibration of the layered body 21 can be easily transmitted to the vibrating body 10.

The joining layer 40 can be a known resin layer, such as an epoxy resin, a silicone resin, or a polyester resin, but is not limited to these resins. Further, as a method of curing the resin used for the joining layer 40, any method, such as thermal curing, photo curing, or anaerobic curing, may be used.

The frame body 30 is provided in an outer periphery of the vibrating body 10, and plays a role to hold the vibrating body 10 to form a fixed end of vibration. For example, as illustrated in FIGS. 1B and 1C, the frame body 30 is configured such that an upper frame member 30*a* and a lower frame member 30*b*, both having a rectangular shape, are joined up and down. Then, the upper frame member 30*a* and the lower frame member 30*b* sandwich the outer periphery of the vibrating body 10, and fixes the vibrating body 10 with providing a predetermined tension. Therefore, the acoustic generator 1 including the vibrating body 10 having less deformation, such as a deflection, even if used for a long period of time, can be obtained.

The thickness and the material of the frame body 30 are not especially limited. However, in the present embodiment, a stainless material having the thickness of 100 to 5000 μm is used because of excellent mechanical strength and corrosion resistance.

Note that, in the acoustic generator 1 according to the present embodiment, the frame body 30 is configured from the upper frame member 30*a* and the lower frame member 30*b*. However, the frame body 30 may be configured from only one of them. That is, the frame body 30 may just include one of the upper frame member 30*a* and the lower frame member 30*b*.

Further, the acoustic generator 1 according to the present embodiment includes a cover layer 50 provided on the vibrating body 10 of between the frame body 30 and the piezoelectric vibrating element 20 (exciter). In the example illustrated in FIGS. 1B and 1C, the piezoelectric vibrating element 20 and the upper surface 10*a* of the vibrating body 10 are covered with the cover layer 50 made of a resin. To be specific, a resin is poured into the frame of the upper frame member 30*a* of the frame body 30, and the cover layer 50 filled in the frame of the frame body 30 embeds the piezoelectric vibrating element 20, and covers the piezoelectric vibrating element 20 and the upper surface 10*a* of the vibrating body 10. Note that, for easy understanding, illustration of the cover layer 50 is omitted in FIG. 1A.

The resin that forms the cover layer 50 may be an epoxy resin, an acrylic resin, a silicone resin, or rubber. However, these are examples and the resin is not limited to these examples. As described above, by covering of the piezoelectric vibrating element 20 with the cover layer 50, an appropriate damping effect can be induced, and a difference between a resonant peak and a dip can be more suppressed along with suppression of the resonance phenomenon. Therefore, it is favorable. Further, the piezoelectric vibrating element 20 can be protected from an external environment.

Note that, in the acoustic generator 1 according to the present embodiment, the entire upper surface 10*a* of the vibrating body 10 is covered with the cover layer 50. However, the entire upper surface 10*a* is not necessarily covered. That is, in the acoustic generator 1, the piezoelectric vibrating element 20 and at least a part of the upper surface 10*a* of the vibrating body 10 on which the piezoelectric vibrating element 20 is provided may just be covered with the cover layer 50.

Further, the piezoelectric vibrating element 20 includes a protrusion 29 on a surface of the vibrating body 10 side. With the protrusion, the piezoelectric vibrating element 20 decreases a difference between a resonant peak and a dip in a frequency characteristic of sound pressure and suppresses frequency variation of sound pressure as much as possible, and improves sound quality. The protrusion 29 will be described below.

Figure 2:
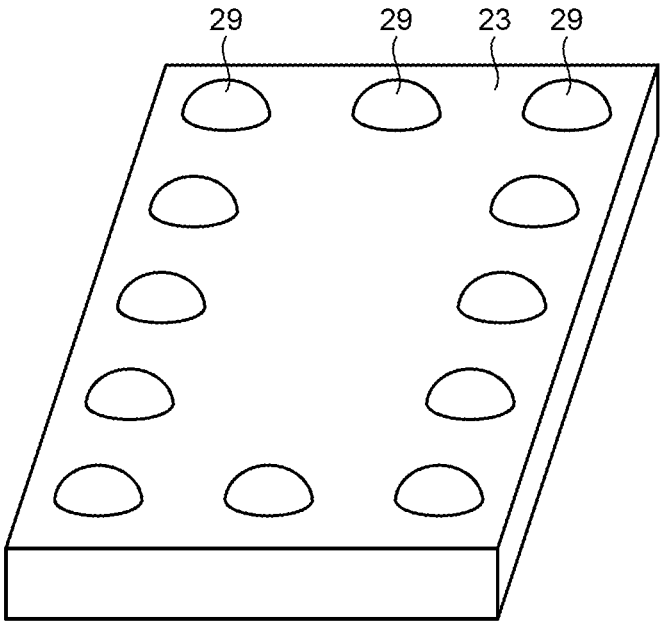
FIG. 2 is a schematic diagram illustrating an arrangement example of protrusions in a piezoelectric vibrating element illustrated in FIG. 1.

FIG. 2 is a schematic diagram illustrating an arrangement example of the protrusions 29 in the piezoelectric vibrating element 20 illustrated in FIG. 1. Note that, in FIG. 2 and the drawings for describing the surface electrode layer 23, a portion of the surface electrode layer 23, which is connected to the external electrode 25 illustrated in FIG. 1B, is illustrated, and illustration of a portion connected to the external electrode 26 is omitted. Further, to make the shape of the protrusion easy to see, FIG. 2 and the drawings for describing the surface electrode layer 23 illustrate a surface 20*a*1 facing the vibrating body 10 of the piezoelectric vibrating element 20 upward.

As illustrated in FIGS. 1B, 1C, and 2, the piezoelectric vibrating element 20 (exciter) includes the surface electrode layer 23 (first electrode) at the side of the surface 20*a*1 facing the vibrating body 10, and a surface of the piezoelectric vibrating element 20 (exciter), the surface including the protrusions 29 and of the vibrating body 10 side, is a surface of the surface electrode layer 23 (first electrode). That is, the protrusion 29 is formed on the surface electrode layer 23 provided between the layered body 21 made of the internal electrode layer 24 and the piezoelectric layers 28*a*, 28*b*, 28*c*, and 28*d*, and the vibrating body 10 so as to protrude from the surface 20*a*1 of the piezoelectric vibrating element 20, the surface 20*a*1 facing the vibrating body 10, toward the vibrating body 10 side.

As described above, the piezoelectric vibrating element 20 includes the protrusions 29 on the surface of the surface electrode layer 23, and thus the thickness of the joining layer 40 is locally different between the vibrating body 10 and the piezoelectric vibrating element 20. As described above, the thickness of the joining layer 40 having a larger energy loss than the piezoelectric vibrating element 20 is different in a portion including the protrusions 29 of the piezoelectric vibrating element 20 and in portion not including the protrusions 29. Therefore, a ratio of a loss of vibration energy transferred from the piezoelectric vibrating element 20 to the vibrating body 10 is changed, the resonance frequency is dispersed, and a peak shape of sound pressure in the resonance frequency of the vibrating body 10 can be made gentle throughout a wide frequency domain. Accordingly, a difference between a resonant peak and a dip in a frequency characteristic of sound pressure is decreased and frequency variation of sound pressure can be suppressed as much as possible, and the sound quality can be improved.

Further, when the joining layer 40 between the protrusion 29 and the vibrating body 10 is extremely thin, the tension of the vibrating body 10 is locally changed in the vicinity of the protrusion 29, the resonance frequency is dispersed, and the peak shape of sound pressure becomes gentle.

Further, the protrusion 29 arranged on the surface of the surface electrode layer 23 is embedded in the joining layer 40 that joins the piezoelectric vibrating element 20 with the vibrating body 10. The protrusion 29 is embedded in the joining layer 40 in this way, so that so-called anchor effect to improve joining strength between the piezoelectric vibrating element 20 and the vibrating body 10 can be obtained. Accordingly, the piezoelectric vibrating element 20 cannot easily come off the vibrating body 10, and as a result, durability of the acoustic generator 1 can be improved.

Figure 3:
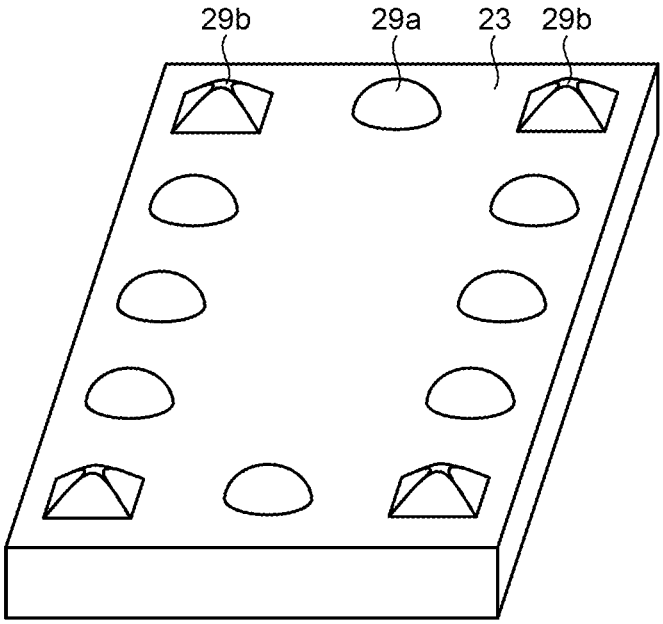
FIG. 3 is a schematic diagram illustrating another arrangement example of protrusions in the piezoelectric vibrating element illustrated in FIG. 1.

Further, in the surface electrode layer 23 illustrated in FIGS. 1B, 1C, and 2, the protrusions 29 having almost the same shapes are arranged on the outer periphery of the side of the surface 20*a*1 illustrated in FIGS. 1B and 1C. However, the protrusions 29 may have different shapes from each other. For example, as illustrated in FIG. 3, a protrusion 29*a* having almost the same shape as the protrusion 29, and a protrusion 29*b* different from the protrusion 29*a* may be provided on a part of the surface electrode layer 23.

As described above, by making of the shapes of the protrusions 29 different from each other, not only the thickness of the joining layer 40 in a vibration direction of the vibrating body 10 in the portion having the protrusions 29 and the portion not having the protrusions 29 is locally different, but also distribution of the thickness of the joining layer 40 in the protrusion 29*a* and in the protrusion 29*b* is locally changed. Accordingly, the ratio of a loss of vibration energy transferred from the piezoelectric vibrating element 20 to the vibrating body 10 is changed, and thus a difference between a resonant peak and a dip in a frequency characteristic of sound pressure is decreased and frequency variation of sound pressure can be suppressed as much as possible, and the sound quality can be improved.

Figure 4:
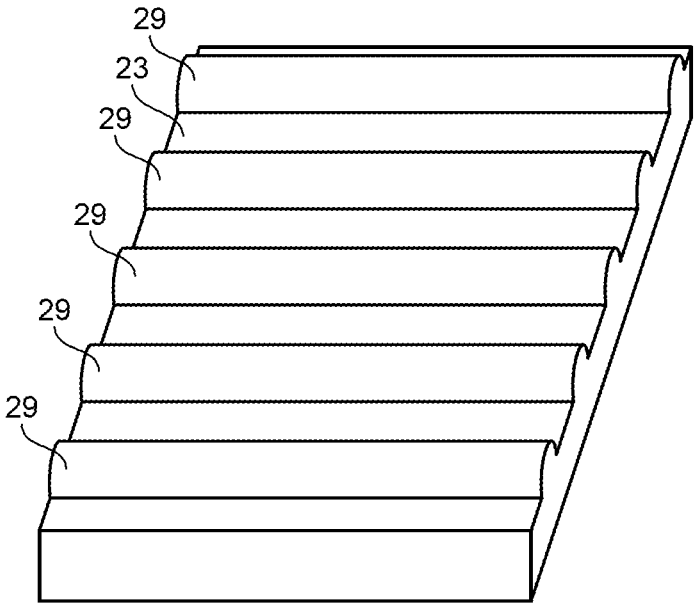
FIG. 4 is a schematic diagram illustrating another arrangement example of protrusions in the piezoelectric vibrating element illustrated in FIG. 1.
Figure 5:
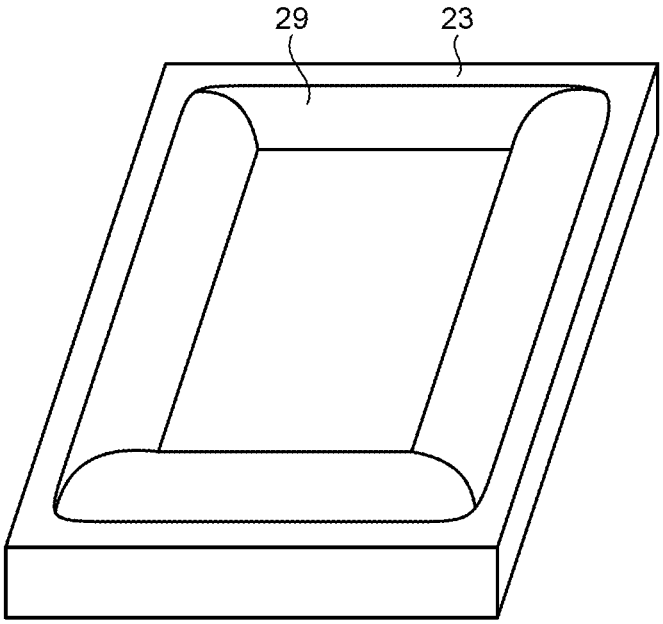
FIG. 5 is a schematic diagram illustrating another arrangement example of protrusions in the piezoelectric vibrating element illustrated in FIG. 1.

Further, in the above-described configurations, the protrusions 29 have so-called a bump shape protruding in a bowl like or a knob like manner. However, the protrusions 29 may have a different shape. For example, as illustrated in FIG. 4, a protrusion 29 having a protruding cross section with a given length in a direction along the surface of the surface electrode layer 23 may be provided. Further, as illustrated in FIG. 5, a protrusion 29 having a protruding cross section formed to surround the outer periphery of the surface of the surface electrode layer 23 may be provided. With such a configuration, the ratio of a loss of vibration energy transferred from the piezoelectric vibrating element 20 to the vibrating body 10 is changed even if the number of protrusions 29 is relatively small, and a difference between a resonant peak and a dip in a frequency characteristic of sound pressure is decreased and frequency variation of sound pressure can be suppressed as much as possible, and the sound quality can be improved. Note that the shapes illustrated as the protrusion 29 are examples, and there is no limitation to the shape of the protrusion 29.

Figure 6:
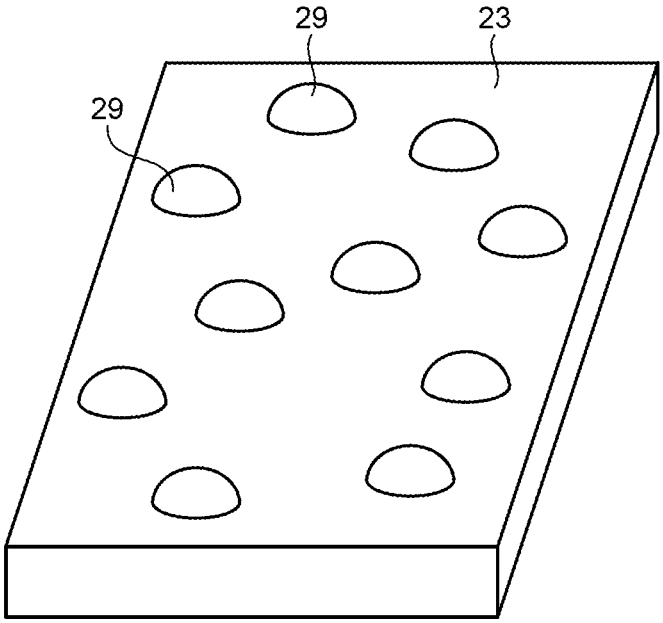
FIG. 6 is a schematic diagram illustrating another arrangement example of protrusions in the piezoelectric vibrating element illustrated in FIG. 1.

Further, in the above-described configurations, the protrusions 29 have some sort of symmetry in a direction along the surface of the surface electrode layer 23. However, the protrusions 29 may be asymmetric to the direction, and for example, as illustrated in FIG. 6, a random arrangement without having symmetry such as rotational symmetry or mirror symmetry may be employed. Accordingly, the resonance frequency of the piezoelectric vibrating element 20 itself that is a vibration source can be further dispersed compared with a case where the arrangement of the protrusions 29 have symmetry, and thus a difference between a resonant peak and a dip can be further decreased, and frequency variation of sound pressure can be suppressed.

As described above, the piezoelectric vibrating element 20 according to the first embodiment includes the protrusions 29 on the surface of the vibrating body 10 side, and thus the ratio of a loss of vibration energy transferred from the piezoelectric vibrating element 20 to the vibrating body 10 is changed. Therefore, in the present embodiment, the resonance frequency is dispersed by the protrusions 29, and a peak shape of sound pressure in the resonance frequency of the vibrating body 10 can be made gentle throughout a wide frequency domain. Accordingly, a difference between a resonant peak and a dip in a frequency characteristic of sound pressure is decreased and frequency variation of sound pressure can be suppressed as much as possible, and the sound quality can be improved. Note that the height of the protrusion 29 is 1 to 30 μm, for example, and the width of the protrusion 29 when a starting point of the protrusion 29 is viewed in the cross section is 1 to 50 μm, for example.

Figure 7:
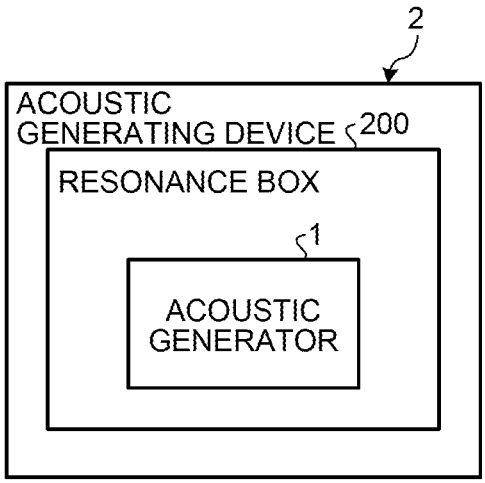
FIG. 7 is a block diagram of an acoustic generating device.

Further, as illustrated in FIG. 7, the acoustic generator 1 having the above-described configuration is housed in a resonance box 200, whereby an acoustic generating device 2 can be configured. The resonance box 200 is a housing configured to place therein the acoustic generator 1, and causes a sound generated from the acoustic generator 1 to resonate, and emits the sound from a housing surface as sound waves. The acoustic generating device 2 can be favorably incorporated in various electronic devices 3, in addition to being used alone as a speaker.

As described above, the acoustic generator 1 can decrease a difference between a resonant peak and a dip in a frequency characteristic of sound pressure, which is difficult for a speaker using resonance of a vibrating body to deal with. Therefore, the acoustic generator 1 according to the present embodiment can be favorably incorporated in the electronic device 3, such as a mobile phone, a thin television, or a tablet terminal.

Note that examples of the electronic device 3 that may be an object in which the acoustic generator 1 is incorporated are not limited to the above-described mobile phone, thin television, and tablet terminal. For example, home electric appliances, such as a refrigerator, a microwave oven, a vacuum cleaner, a washing machine, and the like, sound quality of which have not been regarded as important, are also included.

Figure 8:
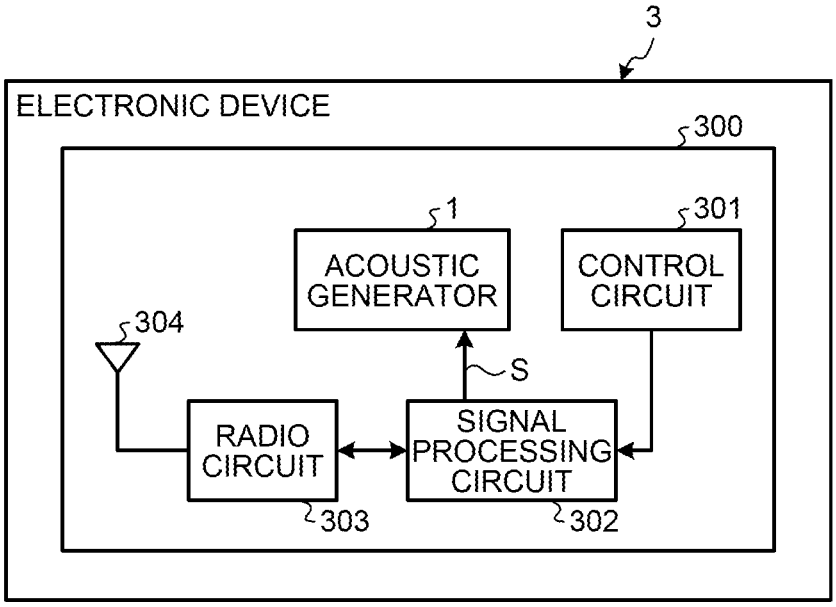
FIG. 8 is a block diagram of an electronic device.

Here, the electronic device 3 including the above-described acoustic generator 1 will be briefly described with reference to FIG. 8. FIG. 8 is a block diagram of the electronic device 3. The electronic device 3 includes the above-described acoustic generator 1, electronic circuits connected to the acoustic generator 1, and a case 300 configured to place therein the acoustic generator 1 and the electronic circuits.

To be specific, as illustrated in FIG. 8, the electronic device 3 includes: electronic circuits including a control circuit 301, a signal processing circuit 302, and a radio circuit 303 as an input device; an antenna 304; and the case 300 for housing these. Note that, while a wireless input device is illustrated in FIG. 8, the input device can be apparently provided as a signal input by normal electrical wiring.

Note that, here, description of other electronic members (for example, devices, such as a display, a microphone, and a speaker, and circuits) included in the electronic device 3 is omitted. Further, one acoustic generator 1 has been exemplarily illustrated in FIG. 8. However, two or more acoustic generators 1 or other transmitters can be provided.

The control circuit 301 controls the entire electronic device 3 including the radio circuit 303 through the signal processing circuit 302. An output signal to the acoustic generator 1 is input from the signal processing circuit 302. Then, upon the signal input to the radio circuit 303, the control circuit 301 makes the signal processing circuit 302 generate an audio signal S, and output it to the acoustic generator 1.

As described above, while incorporating the small and thin acoustic generator 1, the electronic device 3 illustrated in FIG. 8 decreases a difference between a resonant peak and a dip and suppresses frequency variation of sound pressure as much as possible, and can totally improve the sound quality even in a high-pitch range, in addition to a low-pitch range where the frequency is low.

Note that, in FIG. 8, the electronic device 3 that directly incorporates the acoustic generator 1 has been exemplarily illustrated as a sound output device. However, a configuration that incorporates the acoustic generating device 2 that houses the acoustic generator 1 in a housing may be employed as the sound output device.

Second Embodiment

Figure 9:
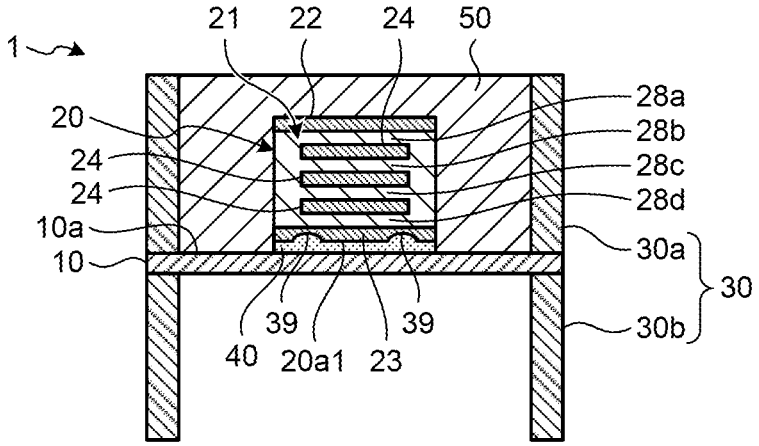
FIG. 9 is a B-B' line cross sectional view of FIG. 1A, illustrating an acoustic generator according to a second embodiment.
Figure 10:
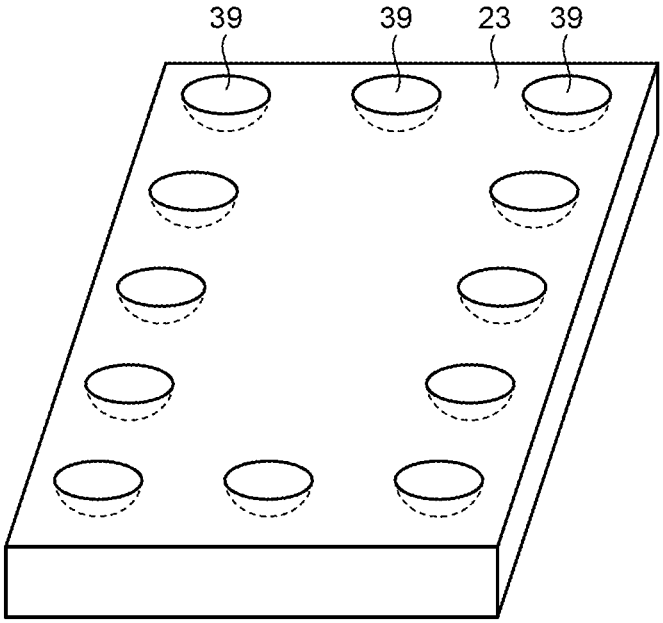
FIG. 10 is a schematic diagram illustrating an arrangement example of recesses in a piezoelectric vibrating element illustrated in FIG. 9.

FIG. 9 is a B-B' line cross sectional view of FIG. 1A, illustrating an acoustic generator 1 according to a second embodiment, and FIG. 10 is a schematic diagram illustrating an arrangement example of recesses in a piezoelectric vibrating element 20 illustrated in FIG. 9. Note that, in FIG. 9, the acoustic generator 1 is extended in an up and down direction, and is deformed and illustrated, for easy understanding. Note that the same configuration as the first embodiment illustrated in FIGS. 1A to 1C is denoted with the same reference signs, and description thereof is omitted.

A piezoelectric vibrating element 20 illustrated in FIGS. 9 and 10 includes a recess 39 in a surface of a vibrating body 10 side, the recess 39 being open to the vibrating body 10 side. To be specific, the piezoelectric vibrating element 20 (exciter) includes a surface electrode layer 23 (first electrode) at a side of a surface facing the vibrating body 10, and a surface of the piezoelectric vibrating element 20 (exciter), the surface including the recess 39 and of the vibrating body 10 side, is a surface of the surface electrode layer 23 (first electrode). That is, the recess 39 is formed in a surface 20*a*1 of the surface electrode layer 23 of the piezoelectric vibrating element 20, the surface 20*a*1 facing the vibrating body 10.

As described above, the piezoelectric vibrating element 20 has the recess 39 formed in the surface of the surface electrode layer 23, and thus a ratio of a loss of vibration energy transferred from the piezoelectric vibrating element 20 to the vibrating body 10 is changed. Therefore, in the piezoelectric vibrating element 20, a resonance frequency is dispersed by the recess 39, and a peak shape of sound pressure in the resonance frequency of the vibrating body 10 can be made gentle throughout a wide frequency domain. Accordingly, a difference between a resonant peak and a dip in a frequency characteristic of sound pressure is decreased and frequency variation of sound pressure can be suppressed as much as possible, and sound quality can be improved. Especially, by providing of the recess in a peripheral portion of the piezoelectric vibrating element 20 where displacement is large (a peripheral edge portion of the surface 20*a*1 facing the vibrating body 10) or in a central portion (a central portion of the surface 20*a*1 facing the vibrating body 10), the thickness of an joining layer 40 having large energy loss is thick in the large displacement portion and the vibration energy can be effectively lost, and the shape of a resonant peak can be made gentle.

Figure 11:
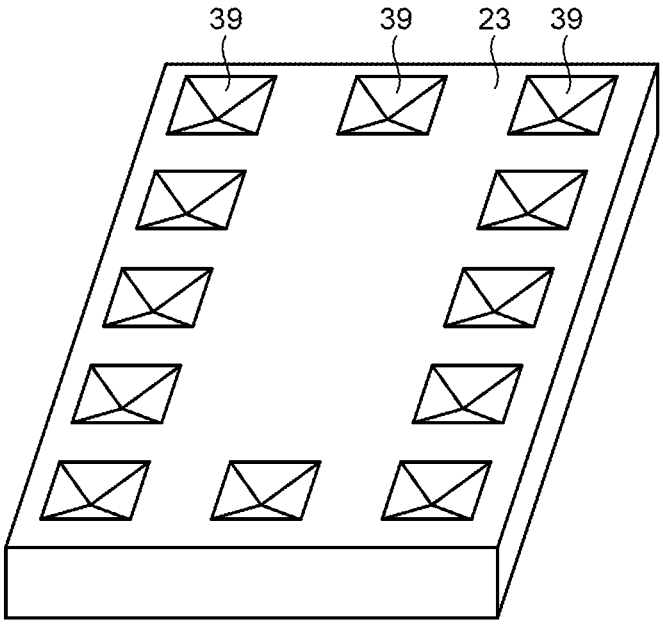
FIG. 11 is a schematic diagram illustrating another arrangement example of recesses in the piezoelectric vibrating element illustrated in FIG. 9.

Further, in the surface electrode layer 23 illustrated in FIG. 10, the recess 39 is arranged to have an arc cross section. However, the shape of the recess 39 may differ. For example, as illustrated in FIG. 11, the recess 39 may have a shape obtained by cutting the surface of the surface electrode layer 23 in a wedge shaped manner or in a pyramid shaped manner. Note that the shapes illustrated as the recess 39 are examples, and there is no limitation to the shape of the recess 39.

Further, in the above-described configurations, the recesses 39 have some sort of symmetry in a direction along the surface of the surface electrode layer 23. However, the recesses 39 may be asymmetric to the direction and may be randomly arranged not to have symmetry such as rotational symmetry or mirror symmetry in the direction along the surface of the surface electrode layer 23.

As described above, according to the second embodiment, the recess 39 is formed in the surface of the surface electrode layer 23, and thus a ratio of a loss of vibration energy transferred from the piezoelectric vibrating element 20 to the vibrating body 10 is changed. Therefore, a difference between a resonant peak and a dip in a frequency characteristic of sound pressure is decreased and frequency variation of sound pressure can be suppressed as much as possible, and the sound quality can be improved.

Note that the depth of the recess 39 falls within a range from 0.5 μm to the thickness of the surface electrode layer 23, for example, and the width of the recess as viewed in the cross section of the recess is 1 to 50 μm, for example.

Third Embodiment

Figure 12:
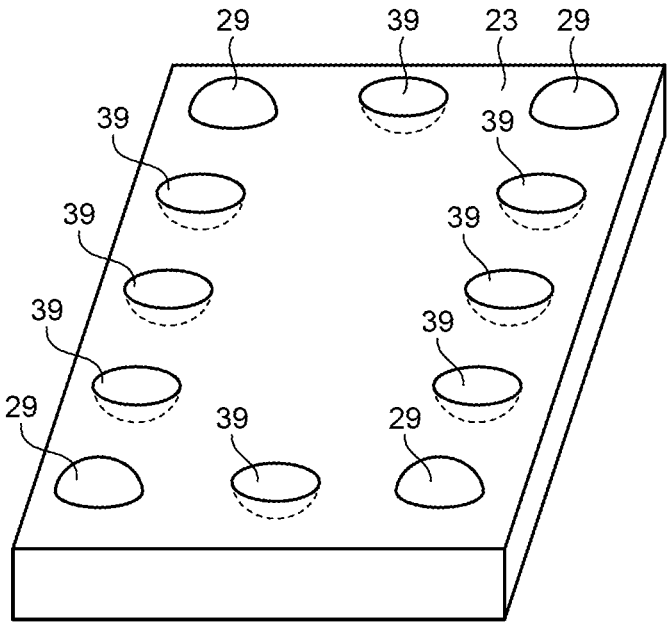
FIG. 12 is a schematic diagram illustrating an arrangement example of protrusions and recesses in a piezoelectric vibrating element that configures an acoustic generator according to a third embodiment.

In the above-described configurations, either the protrusion 29 or the recess 39 is arranged on/in the surface of the surface electrode layer 23. However, both of a protrusion 29 and a recess 39 may be arranged. For example, as illustrated in FIG. 12, on a surface of a surface electrode layer 23, the recesses 39 may be arranged in a part of its outer periphery, and the protrusions 29 may be arranged in the rest of the outer periphery.

As described above, by arrangement of both of the protrusions 29 and the recesses 39 on/in the surface of the surface electrode layer 23, the way of transference of vibration from a piezoelectric vibrating element 20 to a vibrating body 10 is further changed. Therefore, in the piezoelectric vibrating element 20, a resonance frequency is dispersed by the protrusions 29 and the recesses 39, and a peak shape of sound pressure in the resonance frequency of the vibrating body 10 can be made gentle throughout a wide frequency domain. Accordingly, a difference between a resonant peak and a dip in a frequency characteristic of sound pressure is further decreased and frequency variation of sound pressure can be suppressed as much as possible, and sound quality can be further improved.

Further, the embodiment illustrated in FIG. 4 is a configuration in which a surface of the surface electrode layer 23 (a surface 20*a*1 facing the vibrating body 10) is made of the protrusions 29 and the recesses. In this case, a distance between tangents in contact with respective top and bottom (a lowest point) of adjacent protrusion 29 and recess when an arbitrary cross section is viewed is appropriately set to 1 μm or more within a range of the thickness of the surface electrode layer 23 plus 30 μm, for example.

Further, in the above-described embodiments, the protrusion 29 and/or the recess 39 is provided on/in the surface of the surface electrode layer 23. However, there is no limitation as long as the protrusion 29 and/or the recess 39 is formed on/in the surface 20*a*1 side of the piezoelectric vibrating element 20, the surface 20*a*1 facing the vibrating body 10.

Further, the piezoelectric vibrating element 20 (exciter) includes external electrodes 25 and 26 (second electrodes) at side surfaces adjacent to the surface facing the vibrating body 10, and may include the protrusion 29 or the recess 39 on/in surfaces of the external electrodes 25 and 26 (the second electrodes). To be specific, the protrusion 29 or the recess 39 may be provided at a side of the external electrodes 25 and 26, which is close to the surface 20*a*1 facing the vibrating body 10, and for example, a joining layer 40 covers the protrusion 29 or the recess 39, whereby joining strength can be improved.

The embodiments described so far are examples in which the protrusion 29 or the recess 39 is provided on/in the surface of the surface electrode layer 23 or the surfaces of the external electrodes 25 and 26. However, the embodiment is not limited to the example, and the protrusion 29 or the recess 39 may be provided on/in a surface (a lower surface in the drawing) of a layered body 21 corresponding to the surface 20*a*1. For example, when the surface electrode layer 23 is not formed on a lower surface of the layered body 21, the protrusion 29 or the recess 39 may be provided in/on a lower surface of a piezoelectric layer that is a lowermost layer.

Further, the protrusion 29 or the recess 39 may be configured from a plurality of members provided at the side of the surface 20*a*1 facing the vibrating body 10.

As described above, when the protrusion 29 and/or the recess 39 are/is at the side of the surface 20*a*1, the thickness of the joining layer 40 is locally different between the vibrating body 10 and the piezoelectric vibrating element 20. Therefore, a ratio of a loss of vibration energy transferred from the piezoelectric vibrating element 20 to the vibrating body 10 is changed in a portion of the piezoelectric vibrating element 20 having the protrusion 29 and/or the recess 39, and in a portion not having the protrusion 29 and the recess 39.

Therefore, the resonance frequency is dispersed by the protrusion 29 and/or the recess 39, a peak shape of sound pressure in the resonance frequency of the vibrating body 10 can be made gentle throughout a wide frequency domain. Accordingly, a difference between a resonant peak and a dip in a frequency characteristic of sound pressure is decreased and frequency variation of sound pressure can be suppressed as much as possible, and the sound quality can be improved.

Further, when the protrusion 29 is arranged on the surface electrode layer 23 or the external electrodes 25 and 26, the protrusion 29 may be configured from metal as a main component. Further, when the protrusion 29 and/or the recess 39 is provided on/in the surface of the surface electrode layer 23 or the surfaces of the external electrodes 25 and 26, the protrusion 29 and/or the recess 39 may be integrally formed as a part of the surface electrode layer 23 or the external electrodes 25 and 26.

Further, in the above-described embodiments, the piezoelectric vibrating element 20 and the vibrating body 10 are covered with the cover layer 50. However, the embodiment is not limited to this example, and may have a configuration without including the cover layer 50.

Further, in the above-described embodiments, examples in which one piezoelectric vibrating element 20 is arranged on the vibrating body 10 have been exemplarily illustrated. However, two or more piezoelectric vibrating elements may be arranged, as described below.

Figure 13A:
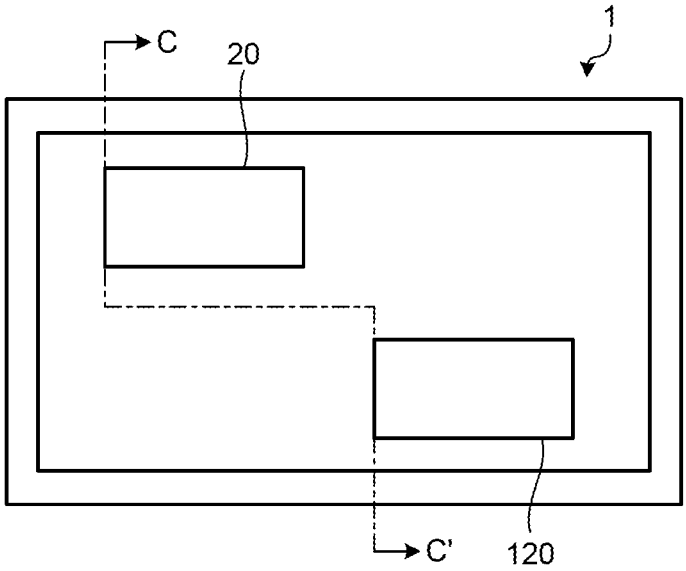
FIG. 13A is a schematic plan view of an acoustic generator according to a modification of the embodiments.
Figure 13B:
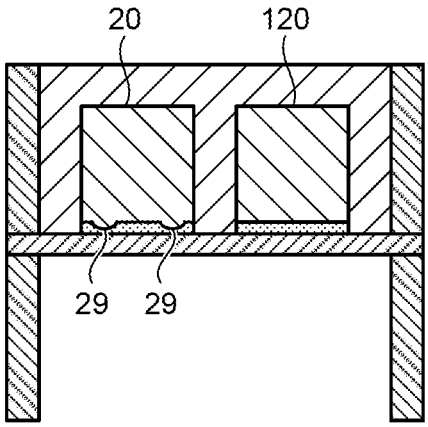
FIG. 13B is a C-C' line cross sectional view of FIG. 13A.

FIG. 13A is a schematic plan view of an acoustic generator according to a modification of the embodiments, and FIG. 13B is a C-C' line cross sectional view of FIG. 13A. Note that, for easy understanding, in FIG. 13B, cross sectional structures of piezoelectric vibrating elements 20 and 120 are omitted.

As illustrated in FIGS. 13A and 13B, a plurality of piezoelectric vibrating elements 20 (exciters) is provided on a vibrating body 10, and at least one of the plurality of piezoelectric vibrating elements 20 (exciters) may be a piezoelectric vibrating element 20 (exciter) having a configuration including a protrusion 29 or a recess 39 on/in a surface of the vibrating body 10 side. To be specific, a configuration in which the protrusion 29 and/or the recess is provided on/in a surface of one piezoelectric vibrating element 20, and a protrusion and/or a recess is not provided on/in a surface of the other piezoelectric vibrating element 120 may be employed. Further, the protrusion 29 may be provided on the surface of one piezoelectric vibrating element 20, and the recess may be provided in the surface of the other piezoelectric vibrating element 120.

Further, in FIGS. 13A and 13B, an example in which the piezoelectric vibrating elements 20 are arranged on the same surface of an upper surface 10*a* of the vibrating body 10 (or a lower surface positioned opposite to the upper surface 10*a*) has been exemplarily illustrated. However, the piezoelectric vibrating elements 20 may be arranged on both of the upper surface 10*a* and the lower surface. Further, the piezoelectric vibrating element 20 has a rectangular shape in plan view. However, the piezoelectric vibrating element 20 may have a square shape. Further, an example in which the piezoelectric vibrating element 20 is arranged in an approximately center of a vibrating surface of the vibrating body 10 has been exemplarily illustrated. However, the piezoelectric vibrating element 20 may be arranged in a position deviated from the center of the vibrating surface of the vibrating body 10.

Further, an example of so-called a bimorph multiplayer has been exemplarily illustrated as the piezoelectric vibrating element 20. However, a unimorph piezoelectric vibrating element can be used.

Note that, in the present embodiment, an example in which the exciter is the piezoelectric vibrating element has been exemplarily illustrated. However, the exciter is not limited to a piezoelectric element, and any exciter can be employed as long as the exciter performs bending vibration when an electrical signal is input and has a function to cause the vibrating body to resonate. For example, an electromagnetic exciter known as an exciter that vibrates a speaker may be employed. Note that the electromagnetic exciter causes an electrical signal to flow in a coil to vibrate a thin plate.

Further effects and modifications can be easily derived by a person skilled in the art. Therefore, a wider range of aspects of the present invention is not limited by specific details and representative embodiments expressed and described above. Therefore, various modifications can be made without departing from the general gist of the concept or the scope of the present invention defined by the scope of the appended claims and its equivalents.

The invention claimed is:

1. An acoustic generator comprising:

a vibrating body; and an exciter provided on the vibrating body via a joining layer, wherein the exciter includes a first electrode layer that has a surface facing the vibrating body, and the surface of the first electrode layer includes a plurality of protrusions or a plurality of recesses that are randomly arranged wherein the exciter includes a second electrode layer that has a side surface adjacent to the surface facing the vibrating body, a part of the surface of the second electrode layer includes a plurality of protrusions or a plurality of recesses, the part being close to the surface facing the vibrating body, and the joining layer covers the plurality of protrusions or the plurality of recesses provided on the surface of the second electrode layer.

2. The acoustic generator according to claim 1, wherein the acoustic generator further comprises one or more exciters provided on the vibrating body, the exciters being provided via joining layers, and at least one of the exciters is an exciter including the first electrode layer whose surface includes the plurality of protrusions or the plurality of recesses that are randomly arranged.

3. The acoustic generator according to claim 1, wherein the protrusion has metal as a main component.

4. The acoustic generator according to claim 1, wherein the exciter is a piezoelectric vibrating element.

5. The acoustic generator according to claim 1, wherein the exciter is a bimorph multilayer piezoelectric vibrating element.

6. The acoustic generator according to claim 1, further comprising:

a frame body provided on an outer periphery of the vibrating body; and a cover layer provided on the vibrating body between the frame body and the exciter.

7. An acoustic generating device comprising:

the acoustic generator according to claim 1; and a housing configured to place therein the acoustic generator.

8. An electronic device comprising:

the acoustic generator according to claim 1;

an electronic circuit connected to the acoustic generator; and a case configured to place therein the electronic circuit and the acoustic generator, wherein the electronic device has a function to cause the acoustic generator to generate a sound.

* * * * *